US010992075B2

(12) United States Patent
Chan

(10) Patent No.: US 10,992,075 B2
(45) Date of Patent: Apr. 27, 2021

(54) ATTACHABLE SURFACE COVER FOR USB PORT

(71) Applicant: Duraflex Hong Kong Limited, Hong Kong (CN)

(72) Inventor: Man Chak Chan, Hong Kong (CN)

(73) Assignee: Duraflex Hong Kong Limited, Hong Kong (CN)

( * ) Notice: Subject to any disclaimer, the term of this patent is extended or adjusted under 35 U.S.C. 154(b) by 0 days.

(21) Appl. No.: 16/772,218

(22) PCT Filed: Nov. 28, 2018

(86) PCT No.: PCT/CN2018/117812
§ 371 (c)(1),
(2) Date: Jun. 12, 2020

(87) PCT Pub. No.: WO2019/134467
PCT Pub. Date: Jul. 11, 2019

(65) Prior Publication Data

US 2021/0091504 A1 Mar. 25, 2021

(30) Foreign Application Priority Data

Jan. 2, 2018 (CN) ..... 201810020471.7

(51) Int. Cl.
*H01R 13/447* (2006.01)
*H01R 13/506* (2006.01)

(52) U.S. Cl.
CPC ..... *H01R 13/447* (2013.01); *H01R 13/506* (2013.01)

(58) Field of Classification Search
CPC .. A41D 27/205; H01R 13/502; H01R 13/447; H01R 13/506
See application file for complete search history.

(56) References Cited

U.S. PATENT DOCUMENTS 2,317,189 A * 4/1943 Heiser ..... H05B 3/342 219/529
4,585,922 A * 4/1986 Berenson ..... H05B 3/06 174/135

(Continued)

FOREIGN PATENT DOCUMENTS

CN 105559322 A 5/2016
CN 205947361 U 2/2017

(Continued)

OTHER PUBLICATIONS

International Search Report of PCT/CN2018/117812, dated Jan. 30, 2019.

*Primary Examiner* — Briggitte R. Hammond
(74) *Attorney, Agent, or Firm* — Collard & Roe, P.C.

(57) ABSTRACT

An attachable surface cover for a USB port has a casing and a base plate. The casing has an attachment component. The casing is attached to a piece of cloth by means of the attachment component penetrating through the cloth. The attachment component is detachably connected to the base plate. The attachable surface cover for a USB port has a plug hole for insertion and removal of a USB cable. An entrance of the plug hole is on the casing. An exit of the plug hole is used to configure a USB port. The attachable surface cover for a USB port of the present invention has a reasonable design and is highly practical.

10 Claims, 6 Drawing Sheets

(56) References Cited

U.S. PATENT DOCUMENTS

| | | | | |
|---|---|---|---|---|
| 6,059,156 | A * | 5/2000 | Lehtinen | A45F 5/02 224/197 |
| 8,157,570 | B2 * | 4/2012 | Chen | H01R 24/38 439/37 |
| 2006/0166520 | A1 * | 7/2006 | Marmaropoulos | H01R 13/639 439/37 |
| 2015/0084592 | A1 | 3/2015 | Pickens et al. | |
| 2019/0133308 | A1 * | 5/2019 | Frash | A45F 5/02 |
| 2019/0280505 | A1 * | 9/2019 | Zhijian | H02J 7/342 |
| 2020/0022425 | A1 * | 1/2020 | Hashiguchi | A41D 1/005 |

FOREIGN PATENT DOCUMENTS

| | | | |
|---|---|---|---|
| CN | 206462605 | U | 9/2017 |
| CN | 206761035 | U | 12/2017 |
| CN | 207677163 | U | 7/2018 |

* cited by examiner

ATTACHABLE SURFACE COVER FOR USB PORT

CROSS REFERENCE TO RELATED APPLICATIONS

This application is the National Stage of PCT/CN2018/117812 filed on Nov. 28, 2018, which claims priority under 35 U.S.C. § 119 of Chinese Application No. 201810020471.7 filed on Jan. 2, 2018, the disclosures of which are incorporated by reference. The international application under PCT article 21(2) was not published in English.

TECHNICAL FIELD

The present invention relates to the field of port accessories, and in particular to an attachable surface cover for a USB port.

BACKGROUND ART

Existing attachable surface covers for a USB port are usually non-detachable and made of hard materials, and thus the attachable surface covers for a USB port and base bodies attached thereby cannot be cleaned. In addition, the attachable surface covers for a USB port cannot be replaced after being damaged. Moreover, high requirements are imposed on materials of the base bodies attached by the attachable surface covers for a USB port, which requires hard cloth or lining to reduce deformation, support a casing, and prevent data cables from being disengaged. In the attachment process, high requirements are also imposed on equipment that attaches the attachable surface cover for a USB port to the base body, which requires professional equipment. On USB ports of the existing attachable surface covers for a USB port, it is necessary to use a vertical insertion and removal method for a USB cable to realize insertion and removal of the USB cable, resulting in poor user experience.

SUMMARY OF THE INVENTION

Technical Problem

The objective of the present invention is to provide an attachable surface cover for a USB port to overcome the technical problems mentioned above.

Solution to Problem

Technical Solution

To solve the technical problems, the present invention uses the following technical solution.

The present invention provides an attachable surface cover for a USB port, comprising a casing and a base plate, wherein the casing has an attachment component; the casing is attached to a piece of cloth by means of the attachment component penetrating through the cloth, and the attachment component is detachably connected to the base plate; the attachable surface cover for a USB port has a plug hole for insertion and removal of a USB cable, and an entrance of the plug hole is on the casing; and an exit of the plug hole is used to configure a USB port.

In the attachable surface cover for a USB port of the present invention, the casing comprises a substrate that is attached to the cloth; the attachment component is formed on the substrate, and several first friction bulges are formed in a protruding manner on a side surface, on which the attachment component is provided, of the substrate; and when the attachment component penetrates through the cloth and then is mounted on the base plate, the first friction bulges abut against the cloth.

In the attachable surface cover for a USB port of the present invention, the cross-sectional area of the plug hole gradually reduces in a direction in which the USB cable is inserted deep into the plug hole.

In the attachable surface cover for a USB port of the present invention, the cloth is provided with a first through hole, the attachment component comprises first attachment pins formed on the substrate, and when the attachment component penetrates through the cloth, the first attachment pins pass through the first through hole.

In the attachable surface cover for a USB port of the present invention, the casing further comprises a base, which is formed in a protruding manner on a side surface, away from the attachment component, of the substrate; the casing is provided with a third through hole, and the base plate is provided with a fourth through hole used to configure a USB port; and when the attachment component penetrates through the cloth and is then mounted on the base plate, the third through hole is in communication with the fourth through hole to form the plug hole.

In the attachable surface cover for a USB port of the present invention, the third through hole is arranged obliquely.

In the attachable surface cover for a USB port of the present invention, several second friction bulges are formed in a protruding manner on the base plate; and when the attachment component penetrates through the cloth and then is mounted on the base plate, the second friction bulges abut against the cloth.

In the attachable surface cover for a USB port of the present invention, first stop members are formed in a protruding manner inside the fourth through hole; each of the first attachment pins comprises a connector connected to the substrate and a second stop member provided on the connector; and when the attachment component penetrates through the cloth and then is mounted on the base plate, the base plate is clamped between the substrate and the second stop members, and the connectors are supported on the first stop members.

In the attachable surface cover for a USB port of the present invention, the cloth is further provided with a second through hole, the attachment component further comprises a second attachment pin formed on the substrate, and when the attachment component penetrates through the cloth, the second attachment pin passes through the second through hole.

In the attachable surface cover for a USB port of the present invention, the base plate is further provided with a limiting slot; and when the attachment component penetrates through the cloth and then is mounted on the base plate, the second attachment pin is clamped in the limiting slot.

BENEFICIAL EFFECTS OF THE INVENTION

Beneficial Effects

The attachable surface cover for a USB port of the present invention uses the detachable connection between the casing and the base plate such that the cloth is fixedly clamped between the casing and the base plate, so that the attachable surface cover for a USB port is detachably fixed on the cloth.

Moreover, the plug hole for insertion and removal of a USB cable is designed such that the cross-sectional area of the plug hole increasingly reduces in a direction in which the USB cable is inserted deep in the plug hole. Thus, the angle of the plug hole for insertion of the USB cable may be larger. Thus, the USB cable can be easily inserted into the plug hole. The attachable surface cover for a USB port of the present invention has a reasonable design and is highly practical.

BRIEF DESCRIPTION OF THE DRAWINGS

Description of the Drawings

Figure 1:
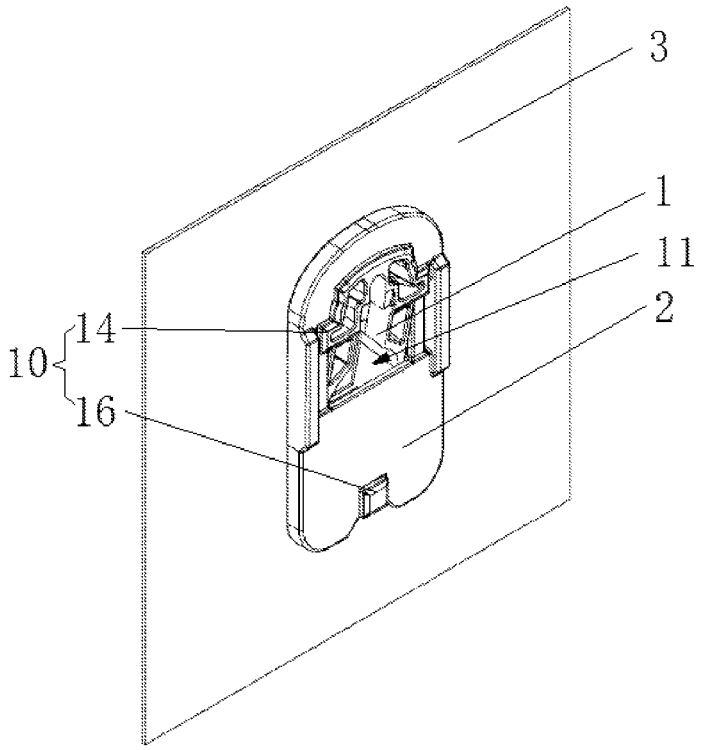
Figure 2:
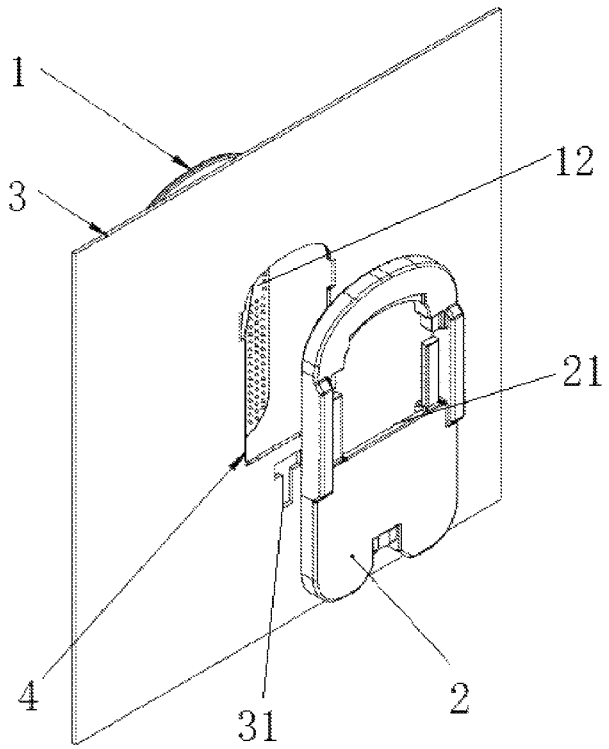
Figure 3:
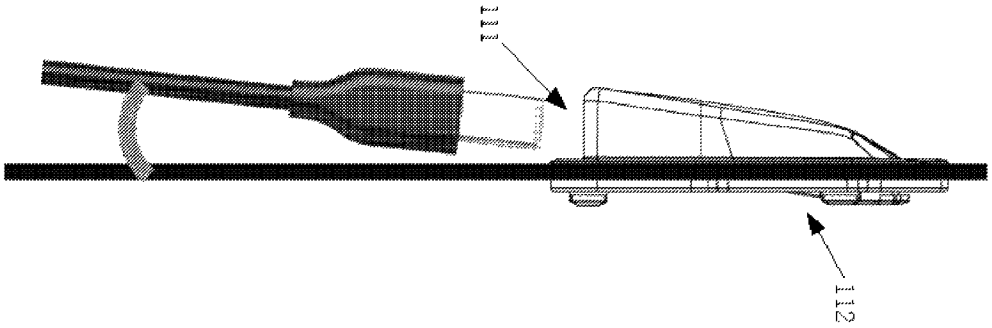
Figure 4:
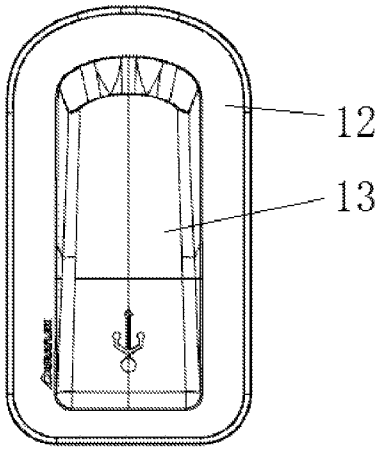
Figure 5:
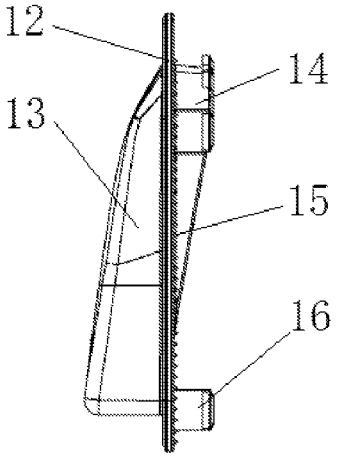
Figure 6:
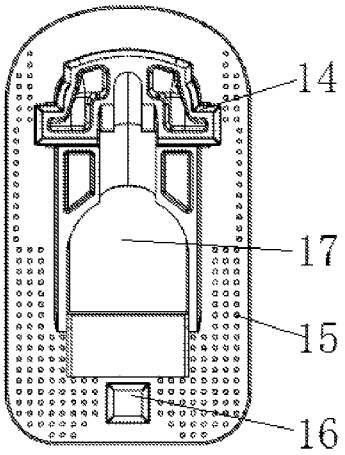
Figure 7:
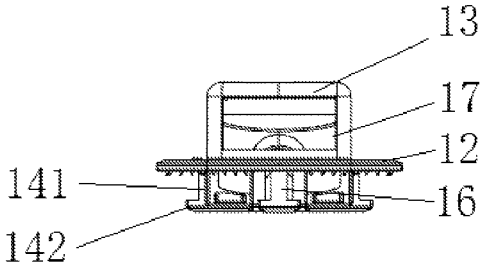
Figure 8:
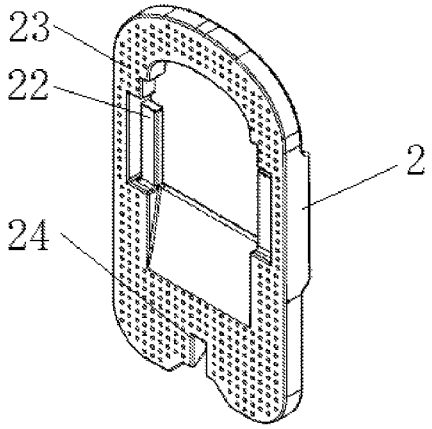
Figure 9:
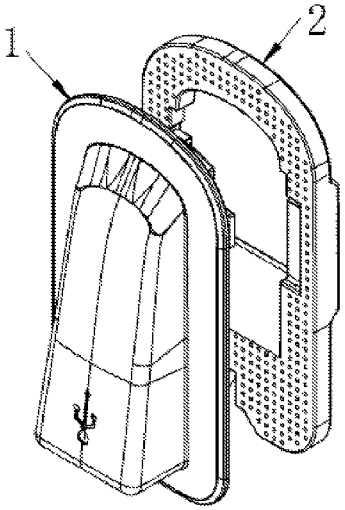

The present invention will be further explained below in conjunction with the accompanying drawings and embodiments. In the accompanying drawings:

FIG. 1 shows a schematic structural diagram of an attachable surface cover for a USB port according to a first embodiment of the present invention;

FIG. 2 shows a diagram of the attachable surface cover for a USB port shown in FIG. 1 in a use state;

FIG. 3 shows another diagram of the attachable surface cover for a USB port shown in FIG. 1 in a use state;

FIG. 4 shows a schematic structural diagram of a casing of the attachable surface cover for a USB port shown in FIG. 1;

FIG. 5 shows a right view of the casing of the attachable surface cover for a USB port shown in FIG. 4;

FIG. 6 shows a rear view of the casing of the attachable surface cover for a USB port shown in FIG. 4;

FIG. 7 shows a bottom view of the casing of the attachable surface cover for a USB port shown in FIG. 4;

FIG. 8 shows a schematic diagram of a base plate shown in FIG. 1;

FIG. 9 shows an exploded view of the attachable surface cover for a USB port shown in FIG. 1.

EMBODIMENTS OF THE INVENTION

Specific Embodiments of the Invention

Technical problems to be solved by the present invention is as follows. Existing attachable surface covers for a USB port are usually non-detachable and cannot be replaced after being damaged. In the attachment process, high requirements are also imposed on equipment which attaches the attachable surface covers for a USB port to the base bodies, which requires professional equipment. On USB ports of the existing attachable surface covers for a USB port, it is necessary to use a vertical insertion and removal method for a USB cable to realize insertion and removal of the USB cable, resulting in poor user experience. The technical ideas proposed by the present invention to solve the technical problem is to configure an attachable surface cover for a USB port, which uses the detachable connection between the casing and the base plate such that the cloth is fixedly clamped between the casing and the base plate, so that the attachable surface cover for a USB port is detachably fixed on the cloth. Moreover, the plug hole for insertion and removal of a USB cable is designed such that the cross-sectional area of the plug hole increasingly reduces in a direction in which the USB cable is inserted deep in the plug hole. Thus, the angle of the plug hole for insertion of the USB cable may be larger. Thus, the USB cable can be easily inserted into the plug hole. The attachable surface cover for a USB port of the present invention has a reasonable design and is highly practical.

To clarify the technical objective, technical solution and technical effects of the present invention so as to facilitate those skilled in the art to understand and implement the present invention, the present invention will be further described in detail below in conjunction with accompanying drawings and specific embodiments.

First Embodiment

Referring to FIG. 1 to FIG. 3, FIG. 1 shows a schematic structural diagram of an attachable surface cover for a USB port according to a first embodiment of the present invention; FIG. 2 shows a diagram of the attachable surface cover for a USB port shown in FIG. 1 in a use state; and FIG. 3 shows another diagram of the attachable surface cover for a USB port shown in FIG. 1 in a use state. The attachable surface cover for a USB port includes a casing 1 and a base plate 2, wherein the casing 1 has an attachment component 10; the casing 1 is attached to a piece of cloth 3 by means of the attachment component 10 penetrating through the cloth 3, and the attachment component 10 is detachably connected to the base plate 2; the attachable surface cover for a USB port has a plug hole 11 for insertion and removal of a USB cable, and an entrance 111 of the plug hole 11 is on the casing 1; and an exit 112 of the plug hole 11 is used to configure a USB port (not shown). Here, the expression "an exit 112 of the plug hole 11 being used to configure a USB port" refers to the USB port entering the plug hole 11 via the exit 112 of the plug hole 11 and being fixed in the plug hole 11, or refers to the USB port being provided at the exit 112 of the plug hole 11. Based on this technical solution, the casing 1 and the base plate 2 are in a detachable connection and fixedly clamp the cloth therebetween, so that the attachable surface cover for a USB port is detachably fixed on the cloth. The cloth 3 may be part of a textile product, such as a bag, clothing, or pants. Thus, an end of the USB cable can be conveniently inserted from the outside of the textile product such as a bag, clothing, or pants.

In this embodiment, as shown in FIGS. 1 and 2, the cloth 3 is provided with a first through hole 4 and a second through hole 31, and the casing 1 comprises a substrate 12 that is attached to the cloth 3; and the attachment component 10 is formed on the substrate 12, the attachment component 10 comprises first attachment pins 14 and a second attachment pin 16 which are respectively formed on the substrate 12, and when the attachment component 10 penetrates through the cloth 3, the first attachment pins 14 pass through the first through hole 4, and the second attachment pin 16 passes through the second through hole 31. Preferably, in this embodiment, two attachment pins 14 are provided, and the two first attachment pins 14 are arranged collinearly with the second attachment pin 16. It can be understandable that in other embodiments, the cloth 3 may have only one through hole through which the attachment 10 passes.

Referring to FIG. 4 to FIG. 7, FIG. 4 shows a schematic structural diagram of a casing 1 of the attachable surface cover for a USB port shown in FIG. 1; FIG. 5 shows a right view of the casing 1 of the attachable surface cover for a USB port shown in FIG. 4; FIG. 6 shows a rear view of the casing 1 of the attachable surface cover for a USB port shown in FIG. 4; and FIG. 7 shows a bottom view of the casing 1 of the attachable surface cover for a USB port shown in FIG. 4. Several first friction bulges 15 are formed in a protruding manner on a side surface, on which the attachment component 10 is provided, of the substrate 12. When the attachment component 10 penetrates through the cloth 3 and then is mounted on the base plate 2, the first friction bulges 15 abut against the cloth 3. When the casing 1 and the base plate 2 are mounted together, several first friction bulges 15 are in concave-convex engagement with the cloth 3, and the soft cloth 3 is supported by the base plate 2 such that the cloth 3 in this state is similar to a hard base material, so that the attachable surface cover for a USB port can be fixed at the position of the cloth 3, and will not be removed or displaced due to wrinkles of the cloth 3.

Further, the cross-sectional area of the plug hole 11 gradually reduces in a direction in which the USB cable is inserted deep in the plug hole 11. Here, the cross-sectional area of the plug hole 11 refers to the cross-sectional area, vertical to the direction in which the USB cable is inserted deep in the plug hole 11, of the plug hole 11. Thus, the angle of the plug hole for insertion of the USB cable may be larger. Even when the attachable surface cover for a USB port is in a motion state, the USB cable can still easily enter the entrance 111 of the plug hole 11 to connect to the USB port.

Specifically, in this embodiment, the casing 1 further comprises a base 13 formed on the substrate 12 in a protruding manner; The base 13 is formed on a side surface, away from the attachment component 10, of the substrate 12; the casing 1 is provided with a third through hole 17, and the base plate 2 is provided with a fourth through hole 21 used to configure a USB port; and when the attachment component 10 penetrates through the cloth 3 and is then mounted on the base plate 2, the third through hole 17 is in communication with the fourth through hole 21 to form the plug hole 11.

Further, Since the casing 1 is usually formed by injection molding or casting, in this embodiment, the third through hole 17 is arranged obliquely, such that using a wedged tool, the cross-sectional area of the third through hole 17 can be very easily gradually reduced in a direction in which the USB cable is inserted deep in the plug hole 11. Here, the cross-sectional area of the third through hole 17 refers to the cross-sectional area, vertical to the direction in which the USB cable is inserted deep in the plug hole 11, of the third through hole 17. Thus, the USB cable is connected to the USB port when being inserted deep in the plug hole, so that the end of the USB cable is fixed. It can be understandable that in other embodiments, the casing 1 may also be formed by means of punching, 3D printing, etc., or a combination thereof.

Referring to FIGS. 8 and 9, FIG. 8 shows a schematic diagram of a base plate 2 shown in FIG. 1; and FIG. 9 shows an exploded view of the attachable surface cover for a USB port shown in FIG. 1. Several second friction bulges 23 are formed in a protruding manner on the base plate 2. When the attachment component 10 penetrates through the cloth 3 and then is mounted on the base plate 2, the second friction bulges 23 abut against the cloth 3. Thus, several second friction bulges 23 are also in concave-convex engagement with the cloth 3.

Referring to FIGS. 7 and 8, first stop members 22 are formed in a protruding manner inside the fourth through hole 21; each of the first attachment pins 14 comprises a connector 141 connected to the substrate 12 and a second stop member 142 provided on the connector 141; and when the attachment component 10 penetrates through the cloth 3 and then is mounted on the base plate 2, the base plate 2 is clamped between the substrate 12 and the second stop members 142, and the connectors 141 are supported on the first stop members 22. In this embodiment, two first stop members 22 are provided, and the connectors 141 of the two first attachment pins 14 are respectively supported on the two first stop members 22, realizing firm fixing between the casing 1 and the base plate 2.

Referring to FIG. 8, the base plate 2 is further provided with a limiting slot 24; and when the attachment component 10 penetrates through the cloth 3 and then is mounted on the base plate 2, the second attachment pin 16 is clamped in the limiting slot 24.

Second Embodiment

The second embodiment is different from the first embodiment in the structure of the base plate 2.

In this embodiment, on the base plate 2, the fourth through hole 21 is substituted by a blind hole or a limiting slot. Thus, the casing 1 and the base plate 2 can still be connected and fixed. However, in this embodiment, it is difficult to assemble and disassemble the casing 1 and the base plate 2.

The attachable surface cover for a USB port of the present invention uses the detachable connection between the casing and the base plate such that the cloth is fixedly clamped between the casing and the base plate, so that the attachable surface cover for a USB port is detachably fixed on the cloth. Moreover, the plug hole for insertion and removal of a USB cable is designed such that the cross-sectional area of the plug hole increasingly reduces in a direction in which the USB cable is inserted deep in the plug hole. Thus, the angle of the plug hole for insertion of the USB cable may be larger. Thus, the USB cable can be easily inserted into the plug hole. The attachable surface cover for a USB port of the present invention has a reasonable design and is highly practical.

It should be understood that those skilled ordinarily skilled in the art could make improvements or modifications on the above description, and all these improvements and modifications should all fall within the scope of protection of the present invention.

The invention claimed is:

1. An attachable surface cover for a USB port, comprising:

a casing with an attachment component, and a base plate detachably connected to the attachment component, wherein the casing is configured to be attached to a piece of cloth by means of the attachment component penetrating through the cloth, wherein the attachable surface cover has a plug hole configured for insertion and removal of a USB cable, wherein an entrance of the plug hole is on the casing, and wherein an exit of the plug hole is used to configure a USB port.

2. The attachable surface cover for a USB port according to claim 1, wherein the casing comprises a substrate that is attachable to the cloth, wherein the attachment component is formed on the substrate, and several first friction bulges are formed in a protruding manner on a side surface of the substrate on which the attachment component is provided, and wherein when the attachment component penetrates through the cloth and then is mounted on the base plate, the first friction bulges abut against the cloth.

3. The attachable surface cover for a USB port according to claim 2, wherein a cross-sectional area of the plug hole is gradually reduced in a direction in which the USB cable is inserted in the plug hole.

4. The attachable surface cover for a USB port according to claim 3, wherein the attachment component comprises first attachment pins formed on the substrate, and wherein when the attachment component penetrates through the cloth, the first attachment pins pass through a first through hole in the cloth.

5. The attachable surface cover for a USB port according to claim 4, wherein the casing further comprises a base, which is formed in a protruding manner on a side surface of the substrate facing away from the attachment component, wherein the casing is provided with a third through hole, and the base plate is provided with a fourth through hole used to configure a USB port; and wherein when the attachment component penetrates through the cloth and is then mounted on the base plate, the third through hole is in communication with the fourth through hole to form the plug hole.

6. The attachable surface cover for a USB port according to claim 5, wherein the third through hole is arranged obliquely.

7. The attachable surface cover for a USB port according to claim 1, wherein several second friction bulges are formed in a protruding manner on the base plate, and wherein when the attachment component penetrates through the cloth and then is mounted on the base plate, the second friction bulges abut against the cloth.

8. The attachable surface cover for a USB port according to claim 5, wherein first stop members are formed in a protruding manner inside the fourth through hole, wherein each of the first attachment pins comprises a connector connected to the substrate and a second stop member provided on the connector, and wherein when the attachment component penetrates through the cloth and then is mounted on the base plate, the base plate is clamped between the substrate and the second stop members, and the connectors are supported on the first stop members.

9. The attachable surface cover for a USB port according to claim 3, wherein the attachment component further comprises a second attachment pin formed on the substrate, and wherein when the attachment component penetrates through the cloth, the second attachment pin passes through a second through hole in the cloth.

10. The attachable surface cover for a USB port according to claim 9, wherein the base plate is further provided with a limiting slot, and wherein when the attachment component penetrates through the cloth and then is mounted on the base plate, the second attachment pin is clamped in the limiting slot.

* * * * *